US010931063B2

(12) United States Patent
Chen

(10) Patent No.: US 10,931,063 B2
(45) Date of Patent: Feb. 23, 2021

(54) HIGH SPEED CONNECTOR ASSEMBLY, SOCKET CONNECTOR AND GROUNDING PLATE

(71) Applicant: OUPIIN ELECTRONIC (KUNSHAN) CO., LTD., Kunshan (CN)

(72) Inventor: Hsin-Chih Chen, Kunshan (CN)

(73) Assignee: OUPIIN ELECTRONIC (KUNSHAN) CO., LTD., Kunshan (CN)

( * ) Notice: Subject to any disclaimer, the term of this patent is extended or adjusted under 35 U.S.C. 154(b) by 0 days.

(21) Appl. No.: 16/709,950

(22) Filed: Dec. 11, 2019

(65) Prior Publication Data

US 2020/0194941 A1 Jun. 18, 2020

(30) Foreign Application Priority Data

Dec. 17, 2018 (CN) ..... 201811539407.6
Dec. 17, 2018 (CN) ..... 201822110865.X

(51) Int. Cl.

| | |
|---|---|
| ***H01R 13/6586*** | (2011.01) |
| ***H01R 13/436*** | (2006.01) |
| ***H01R 13/6596*** | (2011.01) |
| ***H01R 13/05*** | (2006.01) |
| *H01R 107/00* | (2006.01) |

(52) U.S. Cl.

CPC ..... *H01R 13/6586* (2013.01); *H01R 13/055* (2013.01); *H01R 13/4364* (2013.01); *H01R 13/6596* (2013.01); *H01R 2107/00* (2013.01)

(58) Field of Classification Search

CPC ..... H01R 13/6586; H01R 13/055; H01R 13/4364; H01R 13/6596; H01R 210/00

See application file for complete search history.

(56) References Cited

U.S. PATENT DOCUMENTS

| | | | | |
|---|---|---|---|---|
| 8,444,435 | B2 * | 5/2013 | Lee | H01R 13/6587 439/607.07 |
| 8,708,756 | B2 * | 4/2014 | Lee | H01R 13/6461 439/701 |
| 8,894,442 | B2 * | 11/2014 | McClellan | H01R 13/6587 439/607.05 |
| 9,312,642 | B2 * | 4/2016 | Wang | H01R 13/518 |
| 9,373,917 | B2 * | 6/2016 | Sypolt | H01R 13/6585 |
| 9,893,471 | B1 * | 2/2018 | Chen | H01R 13/6585 |
| 10,186,811 | B1 * | 1/2019 | Trout | H01R 13/428 |
| 10,490,950 | B2 * | 11/2019 | Minnick | H01R 13/6588 |

(Continued)

*Primary Examiner* — Abdullah A Riyami
*Assistant Examiner* — Nader J Alhawamdeh
(74) *Attorney, Agent, or Firm* — Mark M. Friedman

(57) ABSTRACT

A high-speed connector assembly, a socket connector and a grounding plate are disclosed in the present invention. The grounding plate disposes multiple grounding arms and multiple shielding pieces, which are arranged in a serpentine pattern for surrounding front mating portions of each pair of differential signal socket terminals to be in a U-shaped state, thereby providing electromagnetic shielding. The grounding plate further disposes multiple spring fingers, which can be used to connect adjacent grounding plates for forming a common grounding path, and further reducing signal cross-talk of adjacent differential pairs. The grounding plate of the present invention can further contact with a corresponding shielding shell of a plug connector to form a complete grounding path, and ensure more stable and reliable signal transmission quality.

9 Claims, 16 Drawing Sheets

(56) References Cited

U.S. PATENT DOCUMENTS

| | | | | |
|---|---|---|---|---|
| 2009/0227141 | A1* | 9/2009 | Pan | H01R 23/688<br>439/607.03 |
| 2009/0233471 | A1* | 9/2009 | Pan | H01R 12/724<br>439/108 |
| 2016/0072231 | A1* | 3/2016 | Sypolt | H01R 13/6597<br>439/607.08 |
| 2019/0081441 | A1* | 3/2019 | Minnick | H01R 13/6588 |
| 2020/0194941 | A1* | 6/2020 | Chen | H01R 13/514 |

* cited by examiner

HIGH SPEED CONNECTOR ASSEMBLY, SOCKET CONNECTOR AND GROUNDING PLATE

BACKGROUND OF THE INVENTION

1. Field of the Invention

The present invention relates to a connector technology, and more particularly to a high-speed connector assembly, a socket connector and a grounding plate, wherein the grounding plate forms multiple grounding arms and multiple shielding pieces, which are arranged in a serpentine pattern on a front of the grounding plate, for fully playing its grounding role and reducing signal crosstalk of the assembly.

2. Description of the Prior Art

A backplane connector is widely used in communication technology. It is one common connector, which is used for large scale communication equipment, a super high performance server, a huge computer, an industrial computer and a high-end storage device. The backplane connectors are to connect daughter cards and backplanes. The daughter card and the backplane are vertical at 90 degrees.

With the continuous improvement of communication technology, the requirement for data transmission rate is also getting higher and higher. A high-speed backplane is a part of a typical electronic system that connects each module physically. A complex system relies on connection lines, routes and connectors of the backplane to process a large number of high-speed data streams. A high-speed backplane connector plays an important role in the communication between multiple backplane modules, so it is necessary to increase the technical research of the backplane connector to meet the signal rate requirements of high-speed communication systems.

The theme of this research is how to ensure the reliability and excellent electrical contact performance of mechanical connection between a high-speed backplane socket connector and a plug connector.

BRIEF SUMMARY OF THE INVENTION

A first object of the present invention is to provide a high-speed connector assembly to ensure excellent signal transmission between a socket connector and a plug connector.

A second object of the present invention is to provide a socket connector, each terminal module of which has a grounding plate, and adjacent grounding plates can be connected and grounded together to reduce signal crosstalk.

A third object of the present invention is to provide a grounding plate for forming multiple grounding arms and multiple shielding pieces, which are arranged in a serpentine pattern on a front of the grounding plate, to fully play its grounding role and reduce signal crosstalk.

Other objects and advantages of the present invention may be further understood from the technical features disclosed by the present invention.

To achieve the aforementioned object or other objects of the present invention, the present invention adopts the following technical solution.

The present invention provides a high-speed connector assembly, comprising a plug connector and a socket connector. The plug connector includes multiple pairs of differential signal plug terminals and multiple shielding shells. Each pair of differential signal plug terminals is half surrounded by one corresponding shielding shell. The socket connector at least includes multiple terminal modules arranged side by side and retained together. Each terminal module at least includes an insulating frame, a terminal group and a grounding plate. The terminal group is retained in the insulating frame and includes multiple grounding terminals and multiple pairs of differential signal socket terminals. Each pair of differential signal socket terminals includes two differential signal socket terminals, each of which has a body, a front mating portion extending forward from one end of the body, and a bottom mounting portion extending downward form the other end of the body. The grounding plate is mounted on one side of the insulating frame. The grounding plate includes a vertical plate fixed on one side of the insulating frame, multiple grounding arms and multiple flat thin shielding pieces. Wherein the grounding arms and the shielding pieces are formed on a vertical edge of the vertical plate to extend forward after being bent and are arranged in a serpentine pattern. The front mating portions of each pair of differential signal socket terminals are surrounded by two grounding arms and one shielding piece to form a U shape. When the socket connector is mated with the plug connector, the front mating portion of each differential signal socket terminal is electrically connected with the corresponding plug terminal, and the grounding arms and the shielding pieces can be electrically connected with the correspond shielding shells.

In one embodiment, at least one grounding arm of each grounding plate has a grounding contact portion being formed on a free end of the grounding arm and protruding toward the shielding piece, and a spring finger protruding in a direction away from the shielding piece; and the spring finger of one grounding plate can contact with the corresponding shielding piece of the other grounding plate.

In one embodiment, the terminal group is located in a vertical plane; one grounding terminal is arranged above and below each pair of differential signal socket terminals; the front mating portion of each differential signal socket terminal is bent to one side from one end of the body and leaves the vertical plane to extend forward; the front mating portion of the differential signal socket terminal includes a long elastic arm extending forward, a short elastic arm extending forward, a first signal contact portion formed on a free end of the long elastic arm, and a second signal contact portion formed on a free end of the short elastic arm; wherein the first and second signal contact portions are horizontally arranged in a straight line, are protruding toward the same one side and perpendicular to the vertical plane; wherein the grounding contact portion, the first signal contact portion and the second signal contact portion are protruding in the same direction, while the spring finger and the grounding contact portion are protruding in the opposite direction.

In one embodiment, each pair of differential signal plug terminals includes two plug terminals, each of which is straight, and has a mating end and a tail end; the mating end has a rectangular cross section, and has two parallel wide surfaces and two parallel narrow surfaces; each shielding shell of the plug connector includes a U-type portion and a tail portion; the U-type portion has two parallel narrow walls and a wide wall connecting the two narrow walls; when the socket connector is electrically docked with the plug connector, the first signal contact portion and the second signal contact portion of each differential signal socket terminal are capable of slipping toward the tail end along one wide surface of the corresponding plug terminal in turn and finally resting on the wide surface; each shielding piece of the grounding plate can contact with the wide wall of the U-type portion of the corresponding shielding shell, and the grounding contact portion of each grounding arm can contact with an edge of the narrow wall of the U-type portion.

The present invention provides a socket connector, comprising an insulating cover and multiple terminal modules. The terminal modules are mounted in the insulating cover and arranged in parallel. Each terminal module at least includes an insulating frame, a terminal group and a grounding plate. The terminal group is retained in the insulating frame and located in a vertical plane. The terminal group includes multiple grounding terminals and multiple pairs of differential signal socket terminals. One grounding terminal is arranged above and below each pair of differential signal socket terminals. Each pair of differential signal socket terminals includes two differential signal socket terminals, each of which has a body located in the vertical plane, a front mating portion being bent to one side from one end of the body and leaving the vertical plane to extend forward, and a bottom mounting portion extending downward form the other end of the body and being located in the vertical plane. The grounding plate is mounted on one side of the insulating frame and includes a vertical plate fixed on one side of the insulating frame, multiple grounding arms and multiple flat thin shielding pieces. Wherein the grounding arms and the shielding pieces are formed on a vertical edge of the vertical plate to extend forward after being bent and are arranged in a serpentine pattern. Wherein in the terminal module, each grounding arm of the grounding plate extends to a front of the corresponding grounding terminal, and is aligned vertically with the front mating portion of each differential signal socket terminal; each shielding piece of the grounding plate faces the front mating portions of the corresponding pair of differential signal socket terminals.

The present invention provides a grounding plate, which is applied in a socket connector. The grounding plate comprises a vertical plate, multiple grounding arms, and multiple shielding pieces. Wherein the grounding arms and the shielding pieces are formed on a vertical edge of the vertical plate to extend forward after being bent; there is one shielding piece between each two adjacent grounding arms; the grounding arms are bent toward one side of the vertical plate and extend forward, and the shielding pieces are bent toward the other side of the vertical plate and extend forward; and the grounding arms and the shielding pieces construct a serpentine pattern.

In comparison with the prior art, the present invention provides a high-speed connector assembly, a socket connector and a grounding plate. The grounding plate of the present invention disposes multiple grounding arms and multiple shielding pieces, which are arranged in a serpentine pattern for surrounding the front mating portions of each pair of differential signal socket terminals to be in a U-shaped state, thereby providing electromagnetic shielding. Moreover, the grounding plate of the present invention disposes multiple spring fingers, which can be used to connect adjacent grounding plates for forming a grounding path, and further reducing signal crosstalk of adjacent differential pairs. Furthermore, the grounding plate of the present invention can contact with the corresponding shielding shell of the plug connector to form a complete grounding path, and ensure more stable and reliable signal transmission quality.

DETAILED DESCRIPTION OF THE PREFERRED EMBODIMENTS

The following description of every embodiment with reference to the accompanying drawings is used to exemplify a specific embodiment, which may be carried out in the present invention. Directional terms mentioned in the present invention, such as "up", "down", "front", "back", "left", "right", "top", "bottom" "above", "below" etc., are only used with reference to the orientation of the accompanying drawings. Therefore, the used directional terms are intended to illustrate, but not to limit, the present invention.

Figure 1:
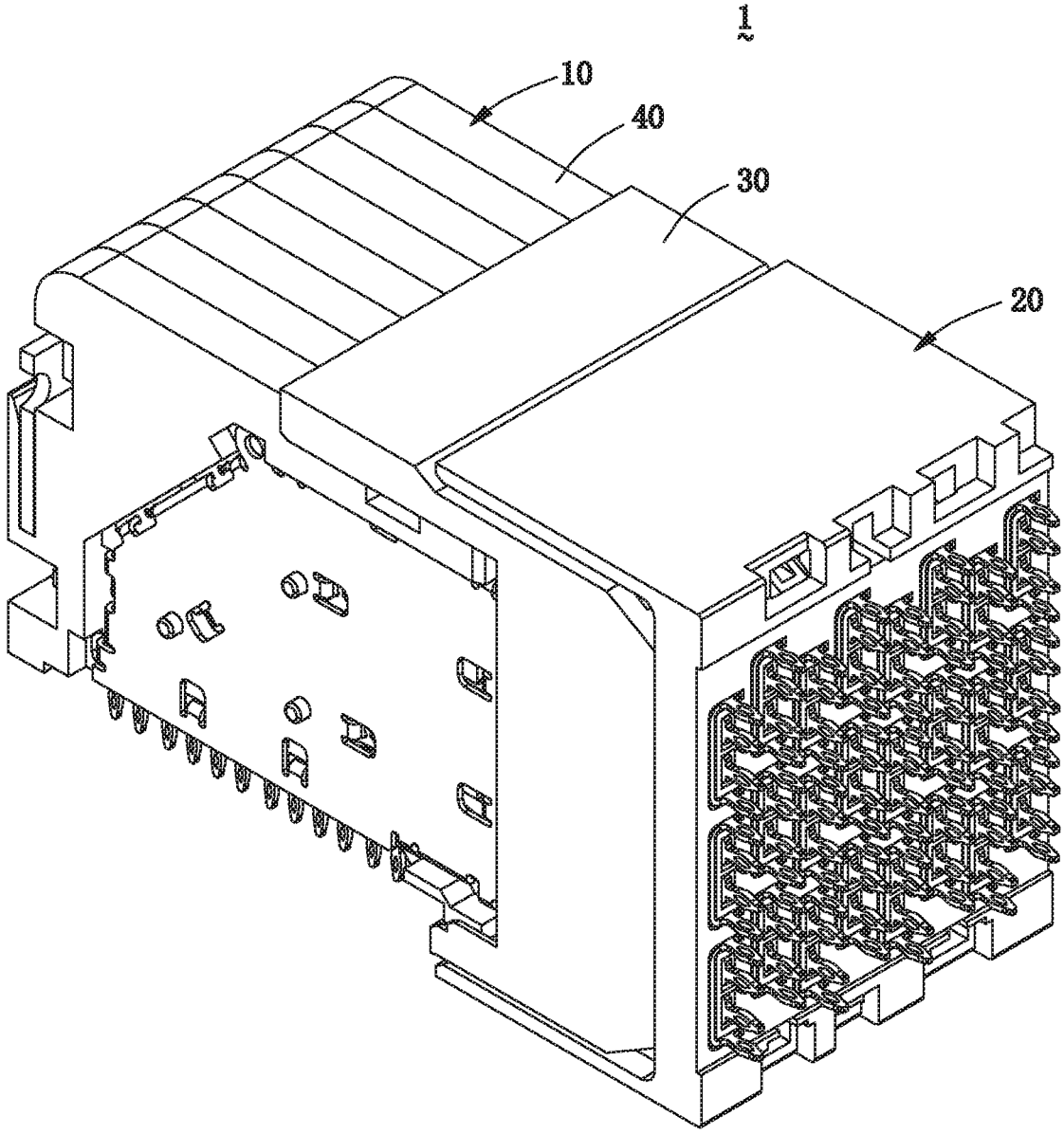
FIG. 1 is a perspective view of a high-speed connector assembly of the present invention.
Figure 2:
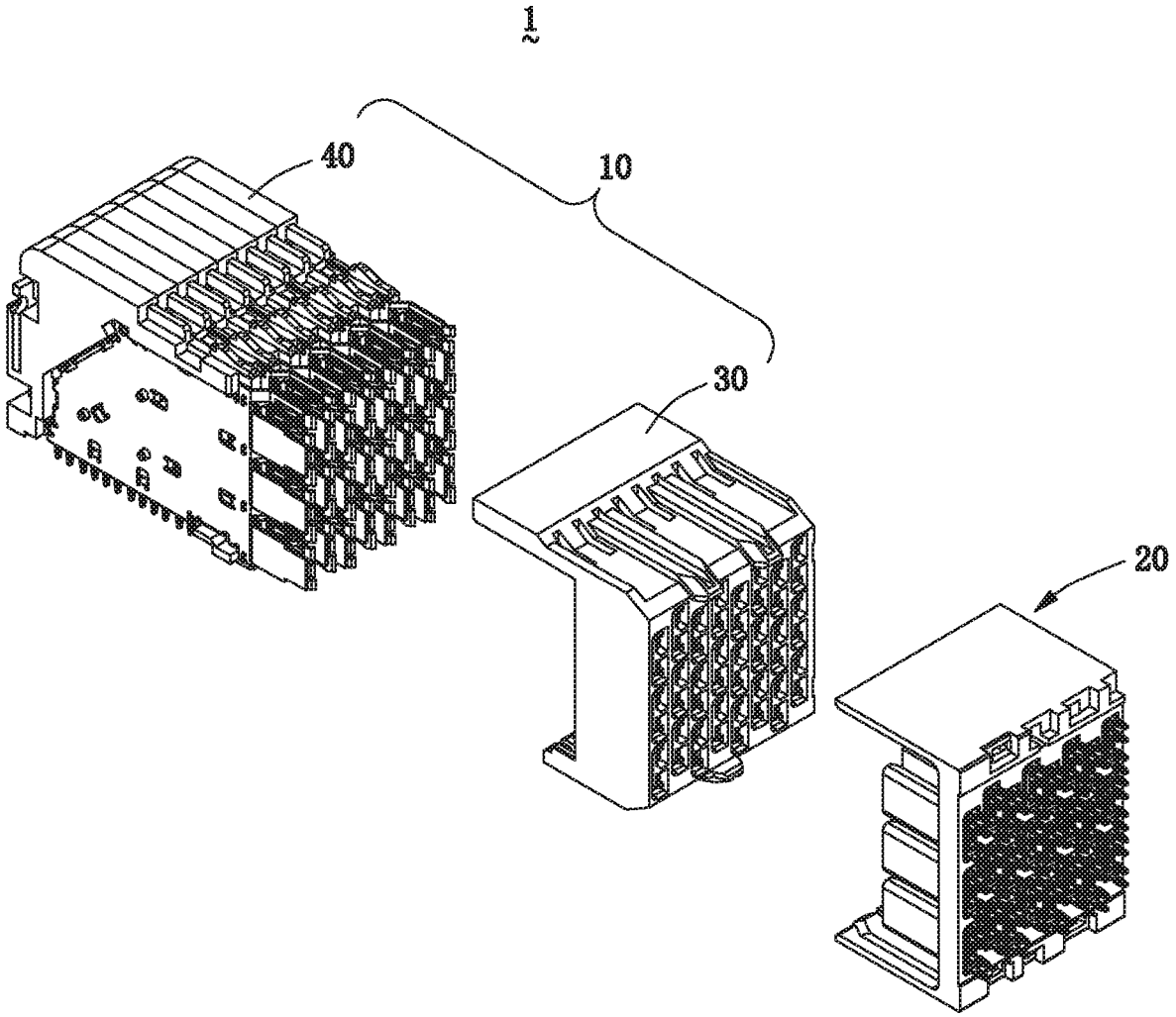
FIG. 2 is a disassembled view of the high-speed connector assembly of the present invention.
Figure 3:
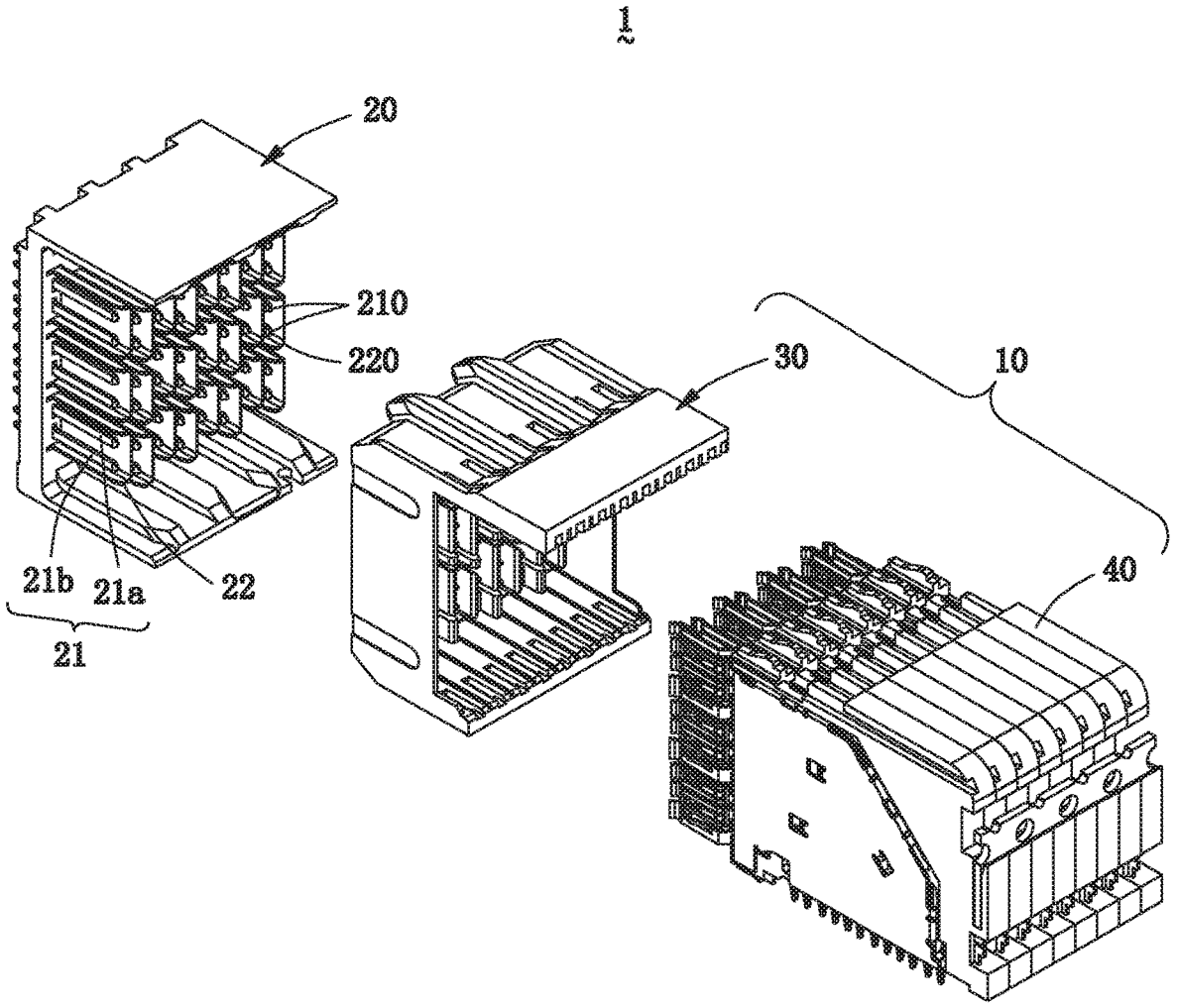
FIG. 3 is a disassembled view of the high-speed connector assembly along another direction.

Please refer to FIGS. 1 to 3, a high-speed connector assembly 1 of the present invention includes a socket connector 10 and a plug connector 20. The socket connector 10 may be a right-angle connector, the mating direction of which is parallel to a horizontal circuit board (not shown), on which the socket connector 10 is mounted. The plug connector 20 may be a vertical end connector, the mating direction of which is perpendicular to a vertical circuit board (not shown), on which the plug connector 20 is mounted.

Referring to FIG. 3, the plug connector 20 has multiple pairs of differential signal plug terminals 21 and multiple shielding shells 22, wherein each pair of differential signal plug terminals 21 is half surrounded by one corresponding shielding shell 22.

Figure 9:
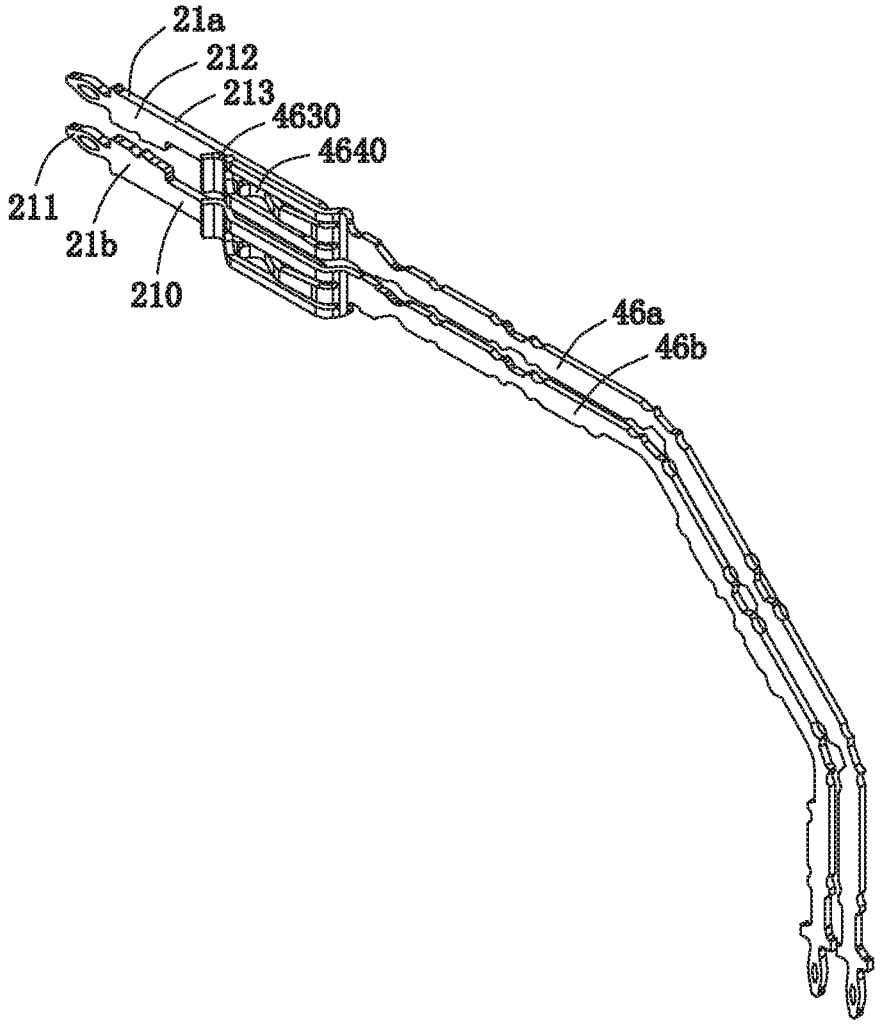
FIG. 9 is a simulation schematic view showing that one pair of differential signal socket terminals of FIG. 8 electrically contact with one pair of plug terminals of a plug connector.

Referring to FIG. 3, each pair of differential signal plug terminals 21 includes two plug terminals 21*a*, 21*b*. Referring to FIG. 9, each plug terminal 21*a* (21*b*) is straight, and has a mating end 210 and a tail end 211. The mating end 210 has a rectangular cross section, and has two parallel wide surfaces 212 and two parallel narrow surfaces 213. The two wide surfaces 212 are perpendicular to the two narrow surfaces 213. It should be noted that, the two narrow surfaces 213 are actually side edges of the mating end 210, or called cut edges.

Figure 11:
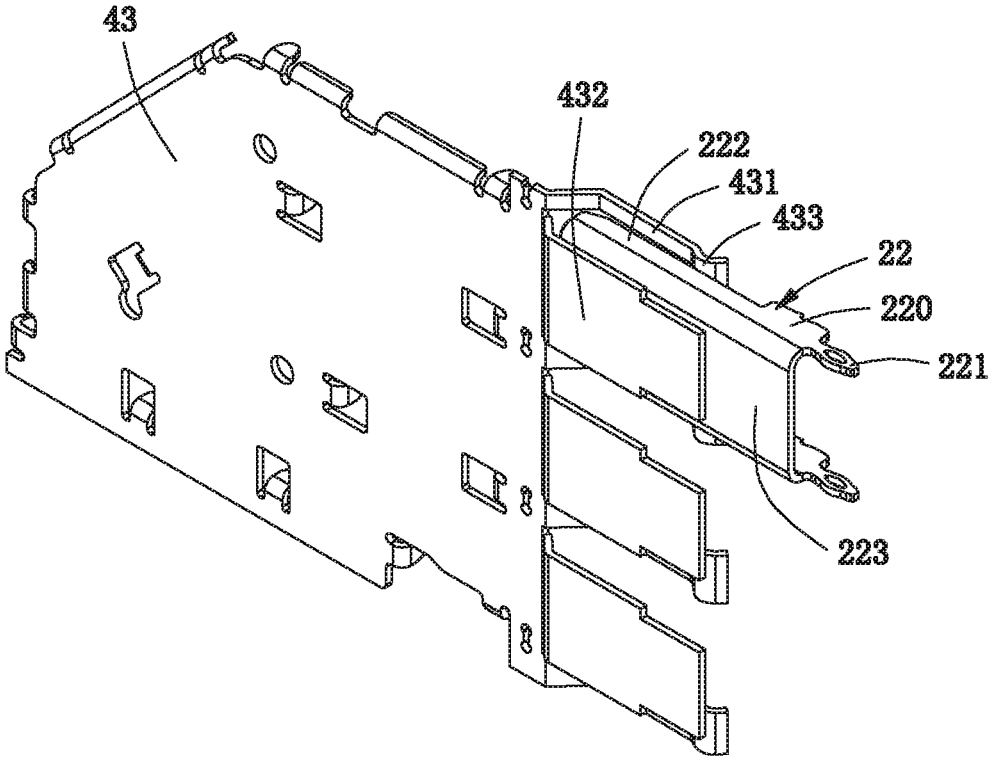
FIG. 11 is a simulation schematic view showing that the grounding plate of FIG. 10 contacts with one shielding shell of the plug connector.

Referring to FIG. 11, each shielding shell 22 includes a U-type portion 220 and a tail portion 221. The U-type portion 220 has two parallel narrow walls 222 and a wide wall 223 connecting the two narrow walls 222. Referring to FIG. 3, the U-type portion 220 of the shielding shell 22 surrounds the mating ends 210 of the corresponding two plug terminals 21*a*, 21*b*.

Referring to FIGS. 1, 2 and 3, the socket connector 10 includes an insulating cover 30 and multiple terminal modules 40 mounted in the insulating cover 30 and arranged side by side from left to right.

Figure 4:
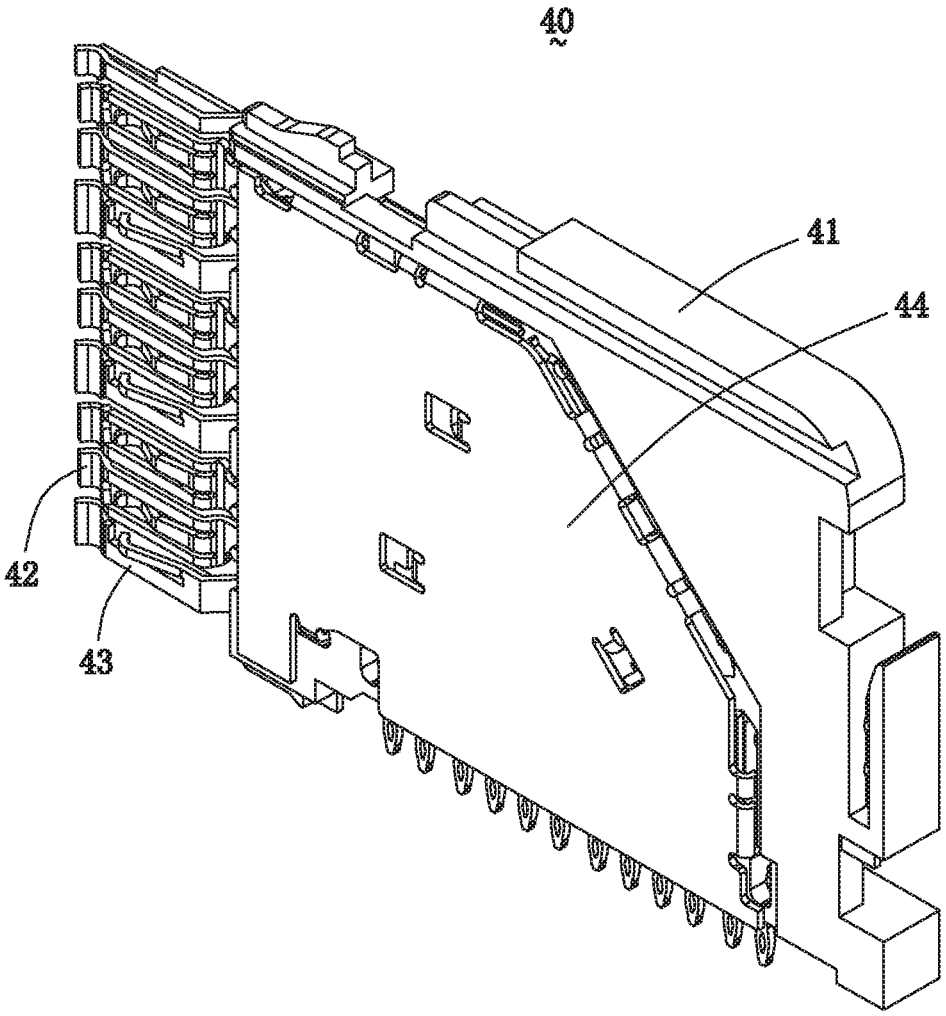
FIG. 4 is a perspective view of a terminal module of the present invention.
Figure 5:
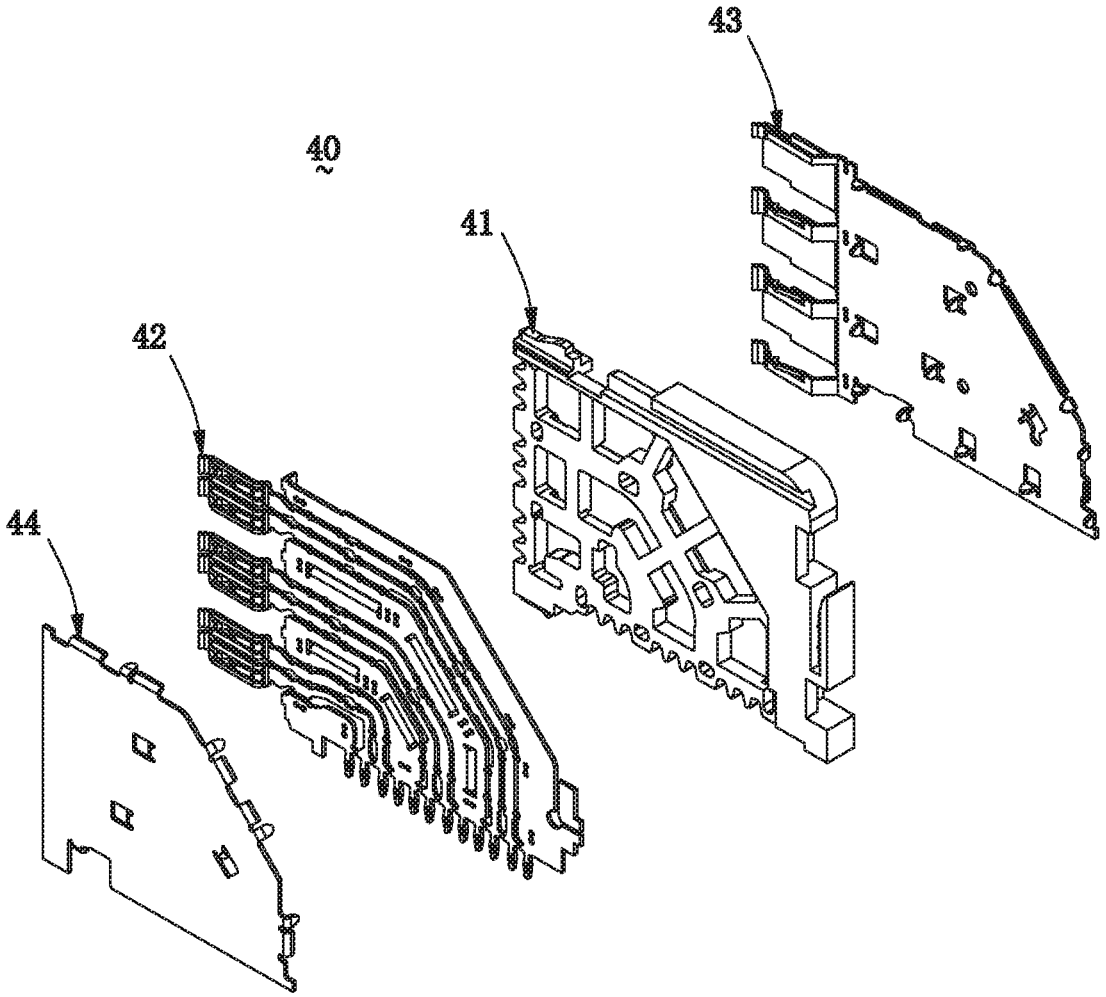
FIG. 5 is an exploded view of the terminal module of FIG. 4.
Figure 6:
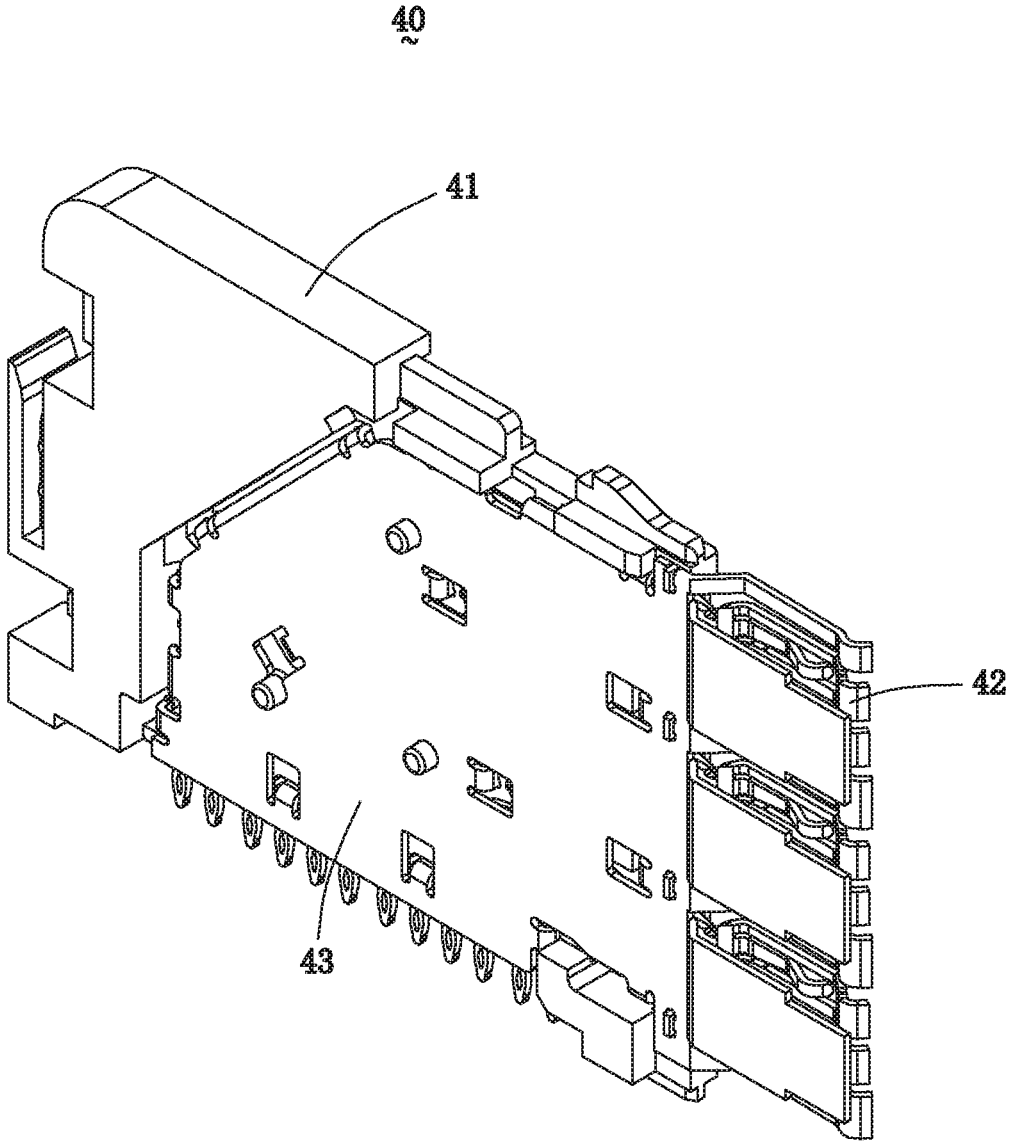
FIG. 6 is a perspective view of the terminal module of the present invention along another direction.
Figure 7:
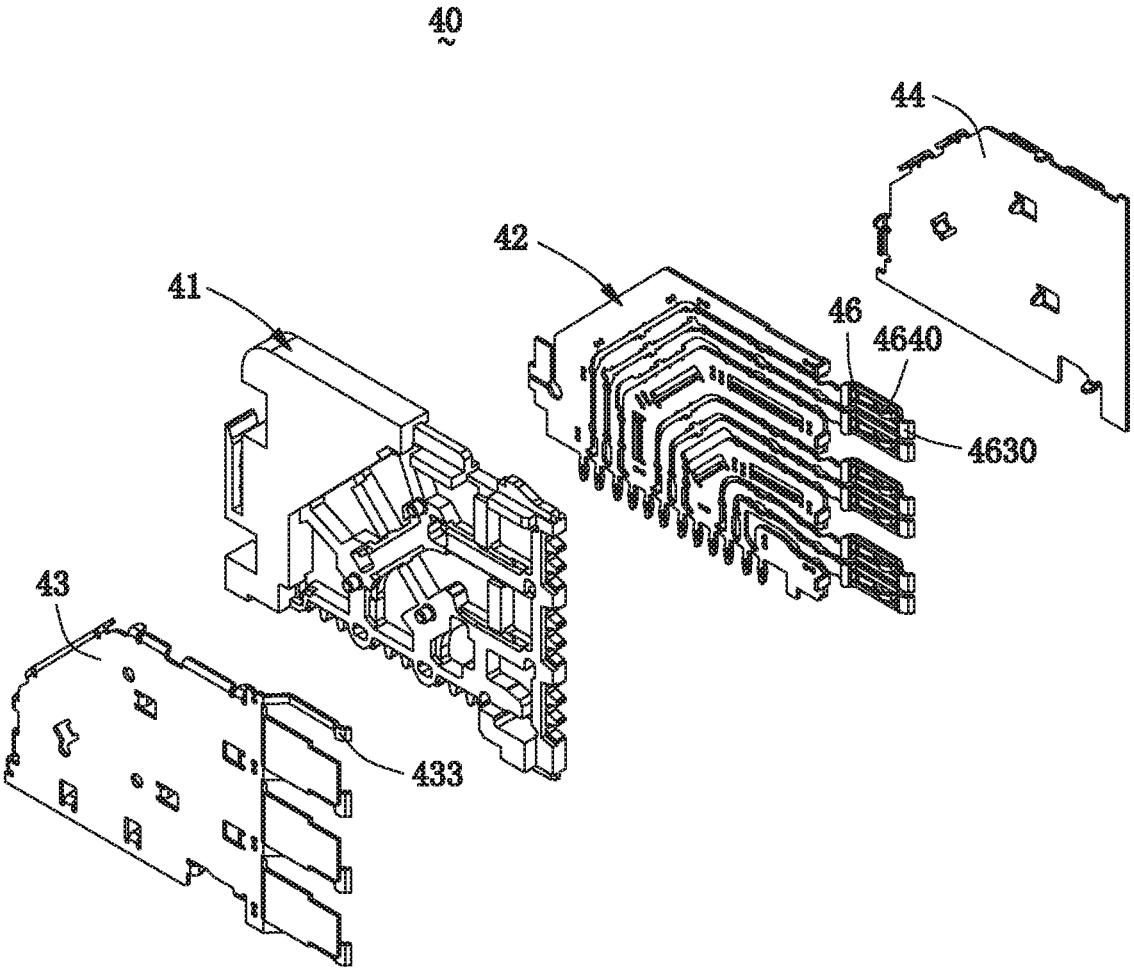
FIG. 7 is an exploded view of the terminal module of FIG. 6.

Referring to FIGS. 4 to 7, each terminal module 40 includes an insulating frame 41, a terminal group 42 retained in the insulating frame 41, a grounding plate 43 mounted on one side of the insulating frame 41, and a metal plate 44 mounted on the other side of the insulating frame 41. In FIGS. 4 and 7, in order to clearly show a structure of the terminal group 42, the terminal group 42 is disassembled from the insulating frame 41. In fact, the terminal group 42 and the insulating frame 41 are combined together by injection molding. Moreover, in the embodiment, both the grounding plate 43 and the metal plate 44 are detachably mounted on both sides of the insulating frame 41 to provide electromagnetic shielding.

Figure 8:
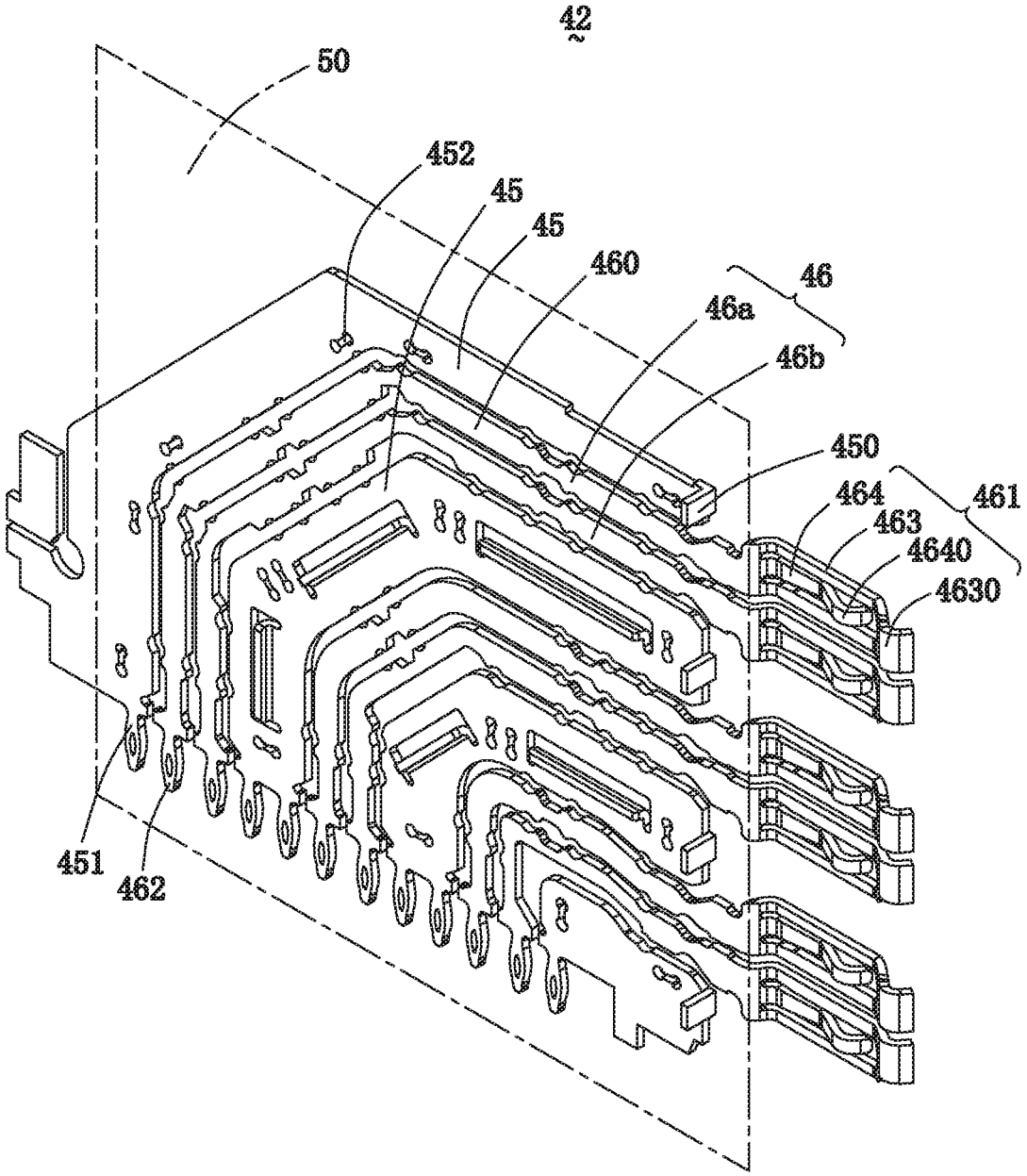
FIG. 8 is a perspective view of one terminal group of a socket connector of the present invention.

Referring to FIG. 8, the terminal group 42 is located in a vertical plane 50. The terminal group 42 includes multiple grounding terminals 45 located in the vertical plane 50 and multiple pairs of differential signal socket terminals 46 located in the vertical plane 50. There is one grounding terminal 45 arranged above and below each pair of differential signal socket terminals 46. In the embodiment, each pair of differential signal socket terminals 46 includes two differential signal socket terminals 46*a*, 46*b*, and the width of each grounding terminal 45 is greater than that of each differential signal socket terminal 46*a*, 46*b*.

Referring to FIG. 8, each grounding terminal 45 is generally L shaped. The grounding terminal 45 has an end part 450 on a front of the grounding terminal and a foot part 451 on a bottom of the grounding terminal. The end part 450 is perpendicular to the vertical plane 50.

The structure of the socket terminal of the present invention will be described in detail with one pair of differential signal socket terminals 46 as an example.

Please refer to FIG. 8, each differential signal socket terminal 46*a* (46*b*) has an L-type body 460 located in the vertical plane 50, a front mating portion 461 being bent to one side from one end of the body 460 and leaving the vertical plane 50 to extend forward, and a bottom mounting portion 462 extending downward from the other end of the body 460 and located in the vertical plane 50.

Please refer to FIG. 8, the front mating portion 461 has a long elastic arm 463 extending forward, a short elastic arm 464 extending forward, a first signal contact portion 4630 formed on a free end of the long elastic arm 463, and a second signal contact portion 4640 formed on a free end of the short elastic arm 464. The first and second signal contact portions 4630, 4640 are horizontally arranged in a straight line. The first and second signal contact portions 4630, 4640 are protruding toward the same one side and perpendicular to the vertical plane 50. Moreover, in the terminal group 42, the bottom mounting portions 462 of all the differential signal socket terminals 46*a*, 46*b* and the foot parts 451 of all the grounding terminals 45 are horizontally arranged in a straight line.

Please refer to FIG. 9, when the socket connector 10 is electrically docked with the plug connector 20 in FIG. 1, the first signal contact portion 4630 and the second signal contact portion 4640 of each differential signal socket terminal 46*a* (46*b*) can slip toward the tail end 211 along one wide surface 212 of the mating end 210 of the corresponding plug terminal 21*a* (21*b*) in turn and finally rest on the wide surface 212, thereby realizing double contact. By this docking way, each pair of socket terminals and each pair of plug terminals corresponding to each other can form a reliable mechanical connection and an excellent electrical contact performance.

The following text will take one grounding plate 43 as an example to illustrate the structure of the grounding plate 43 of the present invention.

Figure 10:
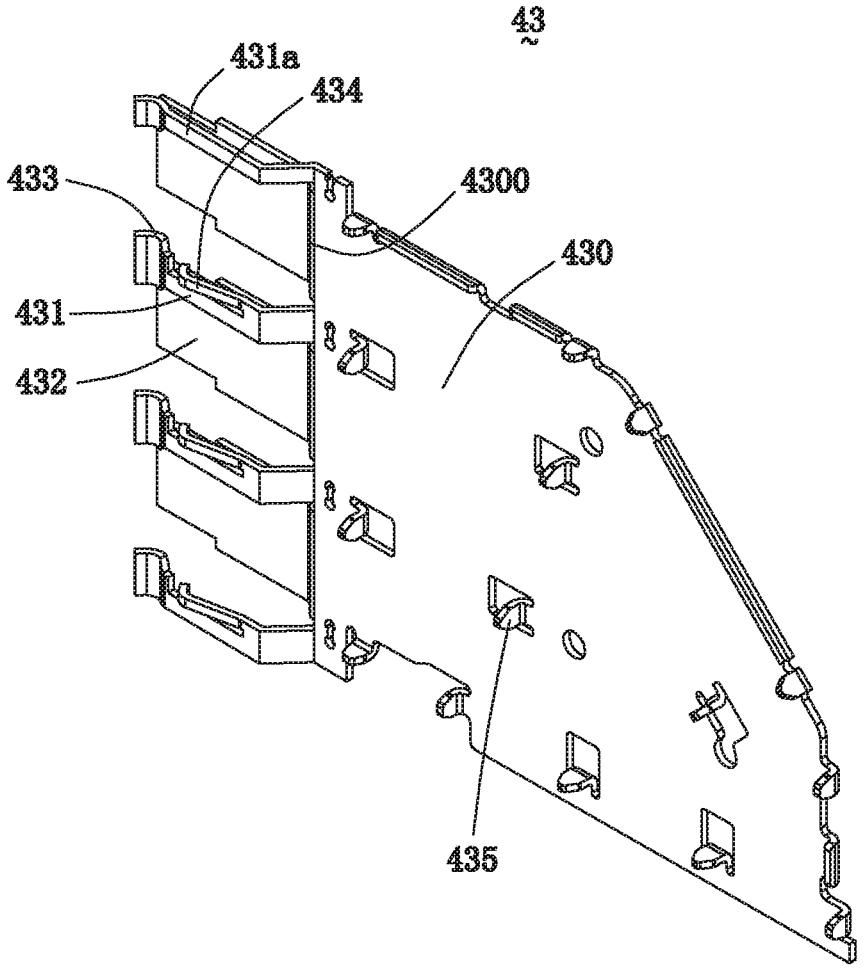
FIG. 10 is a perspective view of a grounding plate of the present invention.

Please refer to FIG. 10, the grounding plate 43 includes a vertical plate 430 fixed on one side of the insulating frame 41, multiple grounding arms 431 and multiple flat thin shielding pieces 432. Wherein the grounding arms 431 and the shielding pieces 432 are formed on a vertical edge 4300 of the vertical plate 430 and extend forward after being bent. There is one shielding piece 432 between each two adjacent grounding arms 431. All of the grounding arms 431 and the shielding pieces 432 are arranged in a serpentine pattern, which can also be called as a W-type pattern or an S-type pattern. In the embodiment, the grounding arms 431 are located on the vertical edge 4300 of the vertical plate 430, are bent toward one side of the vertical plate 430 and extend forward. The shielding pieces 432 are also located on the vertical edge 4300 of the vertical plate 430, are bent toward the other side of the vertical plate 430 and extend forward. So the grounding arms 431 and the shielding pieces 432 construct a serpentine pattern.

Please refer to FIG. 10, at least one grounding arm 431 has a grounding contact portion 433 being on a free end thereof and protruding toward the shielding piece 432, and a spring finger 434 protruding in a direction away from the shielding piece 432. In the embodiment, the grounding plate 43 has four grounding arms 431. There is only one grounding arm 431*a*, such as the upper or lower grounding arm, which has no the elastic finger, while the other three grounding arms 431 are all provided with the spring finger 434.

Please refer to FIG. 11, when the socket connector 10 is electrically mated with the plug connector 20 in FIG. 1, each shielding piece 432 of the grounding plate 43 can contact with the wide wall 223 of the U-type portion 220 of the corresponding shielding shell 22, and the grounding contact portion 433 of each grounding arm 431 can contact with an edge of the narrow wall 222 of the U-type portion 220 of the corresponding shielding shell 22.

In the embodiment, referring to FIG. 7, the first and second signal contact portions 4630, 4640 of each differential signal socket terminal 46 of each terminal module 40 protrude toward the grounding plate 43 of the terminal module 40. The grounding contact portion 433 of the grounding plate 43 protrudes in the same one direction with the first and second signal contact portions 4630, 4640. But the spring finger 434 of the grounding plate 43 protrudes in an opposite direction with the grounding contact portion 433.

Moreover, please refer to FIG. 10, the vertical plate 430 further forms multiple tabs 435 protruding toward the terminal group 42 (seen in FIG. 7). Referring to FIG. 9, each grounding terminal 45 in the terminal group 42 forms multiple locking holes 452.

Figure 12:
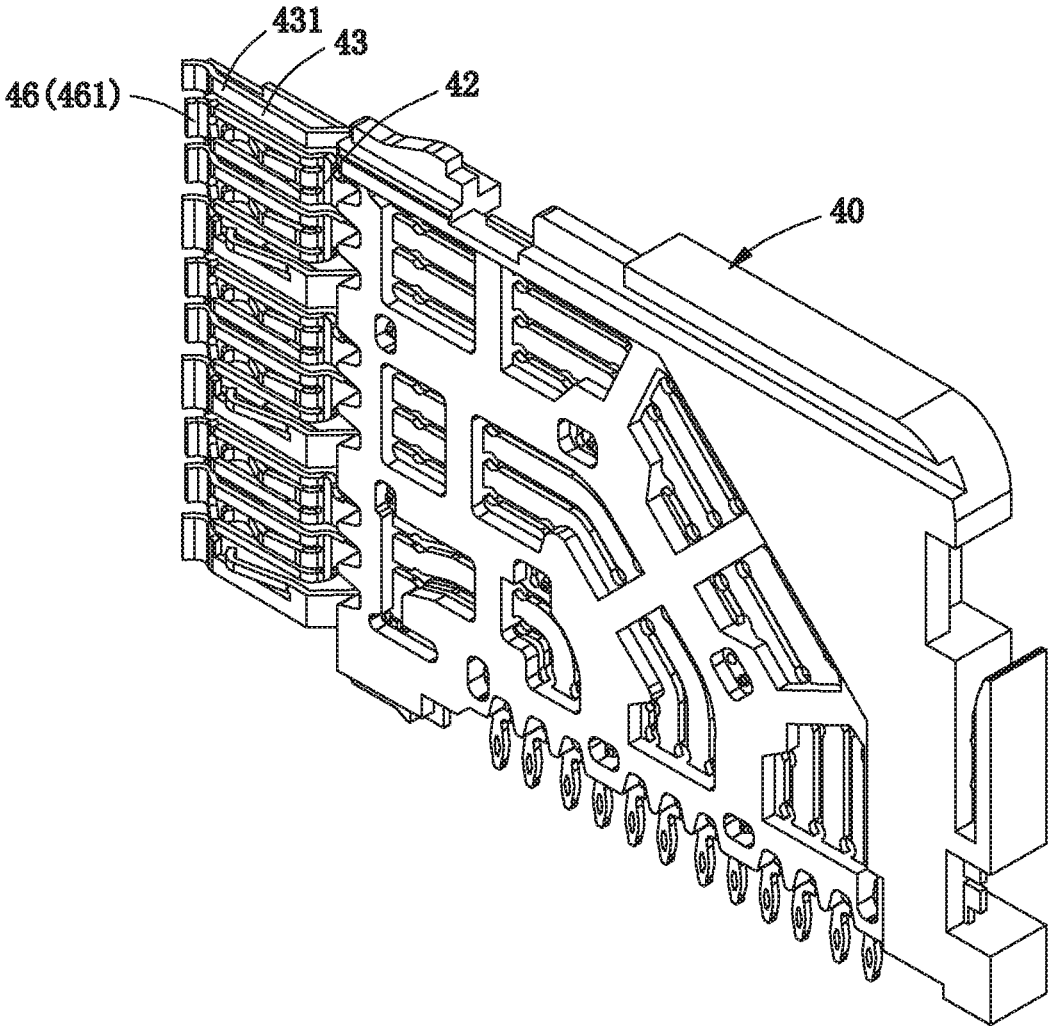
FIG. 12 is a perspective view of the terminal module of FIG. 4 after removing a metal plate.
Figure 13:
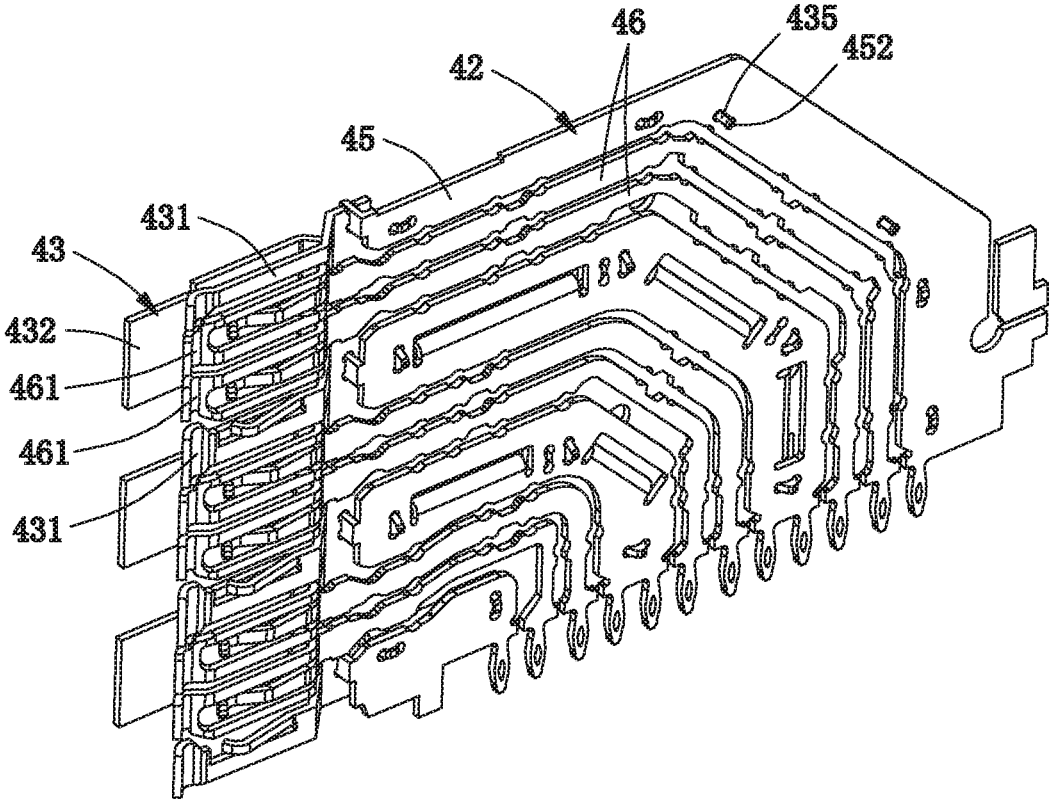
FIG. 13 is a schematic view showing a position relationship and a connection relationship between the grounding plate and the terminal group of the terminal module of FIG. 4.

Please refer to FIGS. 12 and 13, which show a specific relationship of the grounding plate 43 and the terminal group 42 in the terminal module 40. Specifically, in the same one terminal module 40, each grounding arm 431 of the grounding plate 43 extends to the front of the corresponding grounding terminal 45, and is aligned vertically with the front mating portion 461 of each differential signal socket terminal 46. That is, in the same one terminal module 40, the grounding arms 431 and the front mating portions 461 are arranged vertically in a straight line. Moreover, each grounding arm 431 can contact with the end part 450 of the corresponding grounding terminal 45 to form a grounding path. Referring to FIG. 13, two front mating portions 461 in each pair of differential signal socket terminals 46 are located between two grounding arms 431 of the grounding plate 43, and face the same one shielding piece 432. Therefore, in the same one terminal module 40, the two front mating portions 461 of each pair of differential signal socket terminals 46 are surrounded by two grounding arms 431 and one shielding piece 432 to form a U shape. Further, the tabs 435 of the grounding plate 43 are inserted into the locking holes 452 of the corresponding grounding terminals 45, thereby making the grounding plate 43 and all the grounding terminals 45 of the terminal module 40 to be connected together and form a common grounding path. In the embodiment, some of the locking holes 452 are used to retain the grounding plate 43, and others are used to retain the metal plate 44, thereby forming the grounding path of grounding plate 43, the metal plate 44 and the grounding terminals 45. In fact, referring to FIGS. 11 and 13, the grounding plate 43 also forms similarly locking holes (unlabeled) for inserting the end parts 450 (seen in FIG. 8) of the corresponding grounding terminals 45 into it, and connecting the grounding plate 43 and the grounding terminals 45.

Figure 14:
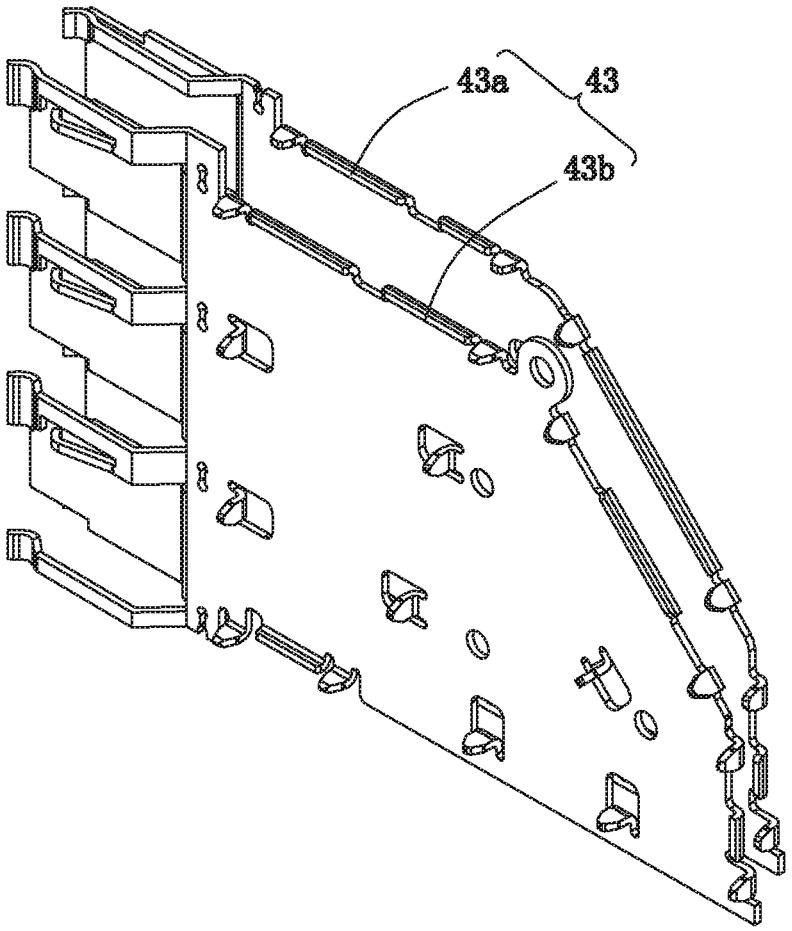
FIG. 14 is a schematic view of a position relationship between adjacent two grounding plates of the present invention.
Figure 15:
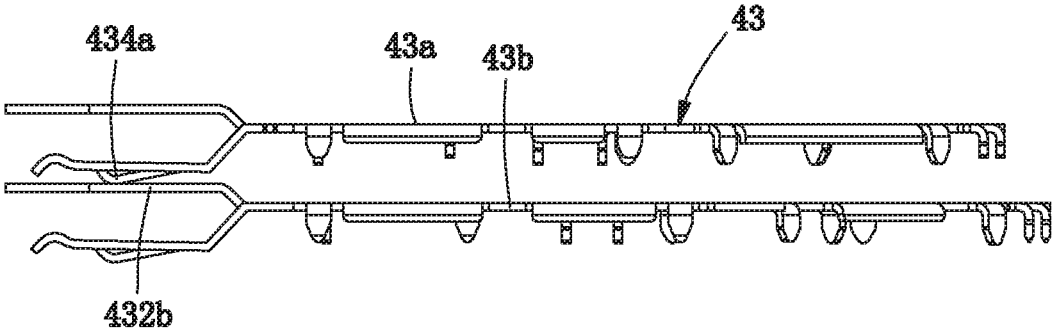
FIG. 15 is a top plan view of the adjacent two grounding plates of FIG. 14, for clearly shown a connection relationship between the adjacent two grounding plates.
Figure 16:
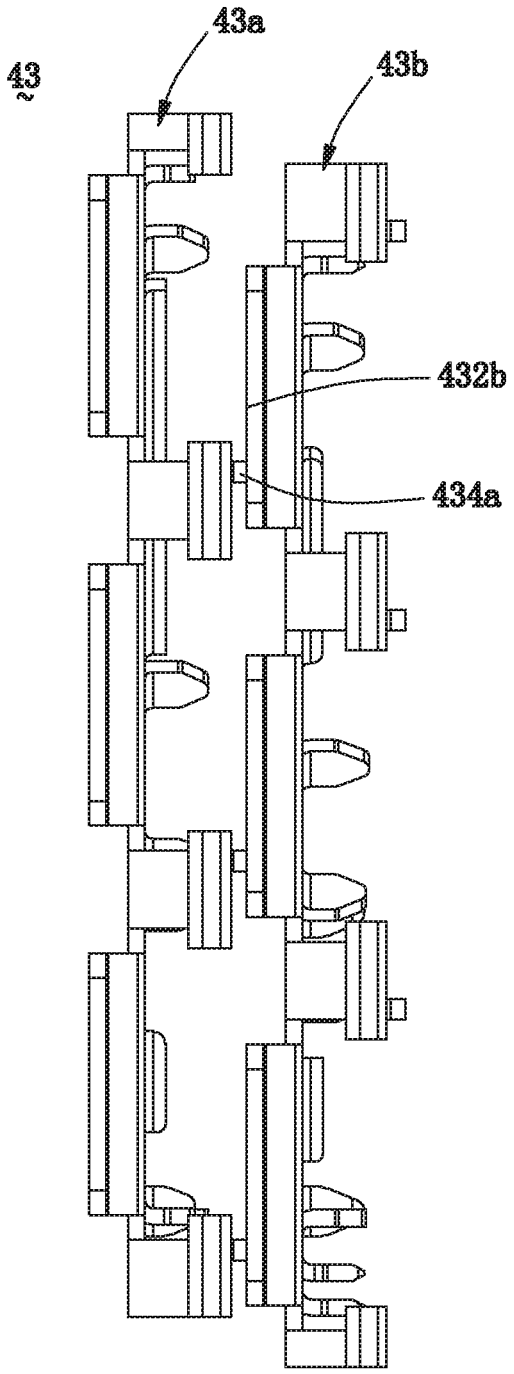
FIG. 16 is a side view of the adjacent two grounding plates of FIG. 14, for clearly showing a connection relationship between the adjacent two grounding plates.

Please refer to FIGS. 14, 15 and 16, in two adjacent terminal module 40, two adjacent grounding plate 43 can be connected together to form a common grounding path, thereby reducing signal crosstalk. Please refer to FIGS. 15 and 16, each spring finger 434*a* of one grounding plate 43*a* can be in contact with or be pressed unto the corresponding shielding piece 432*b* of the other grounding plate 43*b*. By this connection way, all the grounding plates 43 of the socket connector 10 of the present invention are connected together to form a complete grounding path.

As described above, in the present invention, the high-speed connector assembly 1 and the socket connector 10 employ the grounding plates 43, each of which has multiple grounding arms 431 and multiple shielding pieces 432. Wherein there is one shielding piece 432 between each two adjacent grounding arms 431, and all of the grounding arms 431 and the shielding pieces 432 are arranged in a serpentine pattern for surrounding the front mating portions 461 of each pair of differential signal socket terminals 46 to be U-shaped, thereby providing electromagnetic shielding. Moreover, each grounding plate 43 of the present invention disposes multiple spring fingers 434, which can be used to connect adjacent grounding plates 43 for forming a grounding path, and further reducing signal crosstalk of adjacent differential pairs. Furthermore, the grounding plate 43 of the present invention can contact with the corresponding shielding shell 22 of the plug connector 20 to form a complete grounding path, and ensure more stable and reliable signal transmission quality.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A high-speed connector assembly, comprising:

a plug connector, including multiple pairs of differential signal plug terminals and multiple shielding shells; each pair of differential signal plug terminals being half surrounded by one corresponding shielding shell; and a socket connector, at least including multiple terminal modules arranged side by side and retained together; each terminal module at least including:

an insulating frame;

a terminal group, being retained in the insulating frame and including multiple grounding terminals and multiple pairs of differential signal socket terminals; each pair of differential signal socket terminals including two differential signal socket terminals, each of which has a body, a front mating portion extending forward from one end of the body, and a bottom mounting portion extending downward form the other end of the body; and a grounding plate, being mounted on one side of the insulating frame; the grounding plate including a vertical plate fixed on one side of the insulating frame, multiple grounding arms and multiple flat thin shielding pieces; wherein the grounding arms and the shielding pieces are formed on a vertical edge of the vertical plate to extend forward after being bent and are arranged in a serpentine pattern; the front mating portions of each pair of differential signal socket terminals being surrounded by two grounding arms and one shielding piece to form a U shape;

when the socket connector is mated with the plug connector, the front mating portion of each differential signal socket terminal is electrically connected with the corresponding plug terminal, and the grounding arms and the shielding pieces can be electrically connected with the correspond shielding shells.

2. The high-speed connector assembly as claimed in claim 1, wherein at least one grounding arm of each grounding plate has a grounding contact portion being formed on a free end of the grounding arm and protruding toward the shielding piece, and a spring finger protruding in a direction away from the shielding piece; and the spring finger of one grounding plate can contact with the corresponding shielding piece of the other grounding plate.

3. The high-speed connector assembly as claimed in claim 2, wherein the terminal group is located in a vertical plane; one grounding terminal is arranged above and below each pair of differential signal socket terminals; the front mating portion of each differential signal socket terminal is bent to one side from one end of the body and leaves the vertical plane to extend forward;

the front mating portion of the differential signal socket terminal includes a long elastic arm extending forward, a short elastic arm extending forward, a first signal contact portion formed on a free end of the long elastic arm, and a second signal contact portion formed on a free end of the short elastic arm; wherein the first and second signal contact portions are horizontally arranged in a straight line, are protruding toward the same one side and perpendicular to the vertical plane;

wherein the grounding contact portion, the first signal contact portion and the second signal contact portion are protruding in the same direction, while the spring finger and the grounding contact portion are protruding in the opposite direction.

4. The high-speed connector assembly as claimed in claim 3, wherein each pair of differential signal plug terminals includes two plug terminals, each of which is straight, and has a mating end and a tail end; the mating end has a rectangular cross section, and has two parallel wide surfaces and two parallel narrow surfaces;

each shielding shell of the plug connector includes a U-type portion and a tail portion; the U-type portion has two parallel narrow walls and a wide wall connecting the two narrow walls;

when the socket connector is electrically docked with the plug connector, the first signal contact portion and the second signal contact portion of each differential signal socket terminal are capable of slipping toward the tail end along one wide surface of the corresponding plug terminal in turn and finally resting on the wide surface; each shielding piece of the grounding plate can contact with the wide wall of the U-type portion of the corresponding shielding shell, and the grounding contact portion of each grounding arm can contact with an edge of the narrow wall of the U-type portion.

5. A socket connector, comprising:

an insulating cover; and multiple terminal modules, being mounted in the insulating cover and arranged in parallel;

each terminal module at least including:

an insulating frame;

a terminal group, being retained in the insulating frame and located in a vertical plane; the terminal group including multiple grounding terminals and multiple pairs of differential signal socket terminals, wherein one grounding terminal is arranged above and below each pair of differential signal socket terminals; each pair of differential signal socket terminals including two differential signal socket terminals, each of which has a body located in the vertical plane, a front mating portion being bent to one side from one end of the body and leaving the vertical plane to extend forward, and a bottom mounting portion extending downward form the other end of the body and being located in the vertical plane; and a grounding plate, being mounted on one side of the insulating frame; the grounding plate including a vertical plate fixed on one side of the insulating frame, multiple grounding arms and multiple flat thin shielding pieces; wherein the grounding arms and the shielding pieces are formed on a vertical edge of the vertical plate to extend forward after being bent and are arranged in a serpentine pattern;

wherein in the terminal module, each grounding arm of the grounding plate extends to a front of the corresponding grounding terminal, and is aligned vertically with the front mating portion of each differential signal socket terminal; each shielding piece of the grounding plate faces the front mating portions of the corresponding pair of differential signal socket terminals;

wherein at least one grounding arm of each grounding plate has a grounding contact portion being formed on a free end of the grounding arm and protruding toward the shielding piece, and a spring finger protruding in a direction away from the shielding piece; and the spring finger of one grounding plate can contact with the corresponding shielding piece of the other grounding plate.

6. The socket connector as claimed in claim 5, wherein the front mating portion of the differential signal socket terminal includes a long elastic arm extending forward, a short elastic arm extending forward, a first signal contact portion formed on a free end of the long elastic arm, and a second signal contact portion formed on a free end of the short elastic arm; wherein the first and second signal contact portions are horizontally arranged in a straight line, are protruding toward the same one side and perpendicular to the vertical plane; wherein the grounding contact portion, the first signal contact portion and the second signal contact portion are protruding in the same direction, while the spring finger and the grounding contact portion are protruding in the opposite direction.

7. The socket connector as claimed in claim 5, wherein in the terminal module, the vertical plate of the grounding plate forms multiple tabs protruding toward the terminal group, and each grounding terminal forms multiple locking holes thereon; the tabs can be inserted into the corresponding locking holes.

8. The socket connector as claimed in claim 5, wherein the terminal module further includes a metal plate mounted on the other side of the insulating frame and connected with the grounding terminals.

9. A grounding plate, which is applied in a socket connector and comprises:

a vertical plate;

multiple grounding arms; and multiple shielding pieces;

wherein the grounding arms and the shielding pieces are formed on a vertical edge of the vertical plate to extend forward after being bent; there is one shielding piece between each two adjacent grounding arms; the grounding arms are bent toward one side of the vertical plate and extend forward, and the shielding pieces are bent toward the other side of the vertical plate and extend forward; and the grounding arms and the shielding pieces construct a serpentine pattern;

wherein at least one grounding arm has a grounding contact portion being formed on a free end of the grounding arm and protruding toward the shielding piece, and a spring finger protruding in a direction away from the shielding piece.

* * * * *